US007913329B2

(12) United States Patent
Smith

(10) Patent No.: US 7,913,329 B2
(45) Date of Patent: Mar. 29, 2011

(54) ANAL CLEANING DEVICE

(76) Inventor: Graham Hubert Smith, Collaroy Beach (AU)

( * ) Notice: Subject to any disclaimer, the term of this patent is extended or adjusted under 35 U.S.C. 154(b) by 894 days.

(21) Appl. No.: 10/484,153

(22) PCT Filed: Jul. 25, 2002

(86) PCT No.: PCT/AU02/00990

§ 371 (c)(1),
(2), (4) Date: Jan. 5, 2004

(87) PCT Pub. No.: WO03/009733

PCT Pub. Date: Feb. 6, 2003

(65) Prior Publication Data

US 2004/0216224 A1 Nov. 4, 2004

(30) Foreign Application Priority Data

Jul. 25, 2001 (AU) ..... PR6590

(51) Int. Cl.
*E03D 9/08* (2006.01)

(52) U.S. Cl. ..... 4/420.4

(58) Field of Classification Search ..... 4/420.1, 4/448, 420.4, 443, 447; 604/73, 289, 310, 604/311, 150, 212, 217, 257, 275, 279; 239/288, 239/288.3, 288.5, 583, 532, 280
See application file for complete search history.

(56) References Cited

U.S. PATENT DOCUMENTS 1,677,446 A * 7/1928 Hartmetz ..... 239/583 X
1,963,329 A * 6/1934 Hornell ..... 4/448
2,017,801 A * 10/1935 Hornell ..... 4/448
2,034,367 A * 3/1936 Angell ..... 604/150 X
2,289,889 A * 7/1942 Stick et al. ..... 239/288.3 X
2,307,986 A * 1/1943 Brown et al. ..... 604/217 X
2,995,759 A * 8/1961 Gentry ..... 4/420.1
3,019,447 A * 2/1962 Sluz ..... 4/448
4,205,402 A * 6/1980 Miller ..... 4/448
4,287,618 A * 9/1981 Silver ..... 4/443
4,287,888 A * 9/1981 Schwarz ..... 604/150
4,510,630 A * 4/1985 Osgood ..... 4/443
5,833,675 A * 11/1998 Garcia ..... 604/310

OTHER PUBLICATIONS

Merriam-Webster Online Dictionary, definition of "inflexible", 1 pg.*
Merriam-Webster Online Dictionary, definition of "rigid", 1 pg.*

* cited by examiner

*Primary Examiner* — Lori Baker
(74) *Attorney, Agent, or Firm* — Neifeld IP Law, P.C.

(57) ABSTRACT

An anal cleaning device (1) includes a fluid flow directing member (2) connectable to a fluid source (14). The member (2) has a fluid outlet 10*a* for directing fluid from the source out of the member. A wall member (11) projects out from the flow directing member (2) near the fluid outlet (10*a*). The wall member (11) is positionable at a perineum of a user such that, when located thereat, the wall member (11) spaces the fluid outlet (10) a from the user's anus and tends to prevent fluid from reaching that side of the wall member (11) opposite to the fluid outlet (10) a side of the wall member (11). The flow directing member (2) is optionally a detachable cleaning head (10). The wall member (11) can be formed integrally with the head (10) to project orthogonally therefrom and intermediate a first head end (10*b*) connectable to a fluid source line (12) and a second opposite head end (10*c*) near which the fluid outlet (10*a*) is located.

22 Claims, 7 Drawing Sheets

11d
11b
11a
3
11
3

11a
10b
10d
10c
10a
10

11d
2
11
10a
12
12b
10

12
13
13a
17
17a
18
19
19a
20
21
22
23
24
25
26
27
28
29
30
31
32
33
34

ANAL CLEANING DEVICE

FIELD OF THE INVENTION

This invention relates to an anal cleaning device, preferably in the form of a personal hygiene device such as a mini bidet or douche. The anal cleaning device can be used as a hand held device, and may be used in conjunction with the normal low down flushing suite within a toilet facility. However it can also be used in conjunction with non flushing, open and squat down toilet pits as exist in some European and Asian countries, and in other toiletry contexts.

BACKGROUND TO THE INVENTION

Anal cleaning falls into a number of categories:

1) Wiping with paper is by far the most common method used and, whilst commonly accepted, has certain problems in as much as it can be messy, and normal hygiene requires the hands to be washed after the anus is wiped.

Wiping with paper is generally not a perfect way of cleaning the anal area. It can cause irritation and cross contamination to other areas. It can cause the spread of bacteria from hands to food when washing of one's hands is not performed or is inadequate. Also, paper in toilets is prone to run out especially in public toilets. Paper consumption for this operation is enormous.

Excessive use of paper by any one user can cause a blockage in the toilet bowl and happens quite frequently on sea going vessels. A person using this method also has to be of normal build proportions to be physically able to accomplish the reaching of the area concerned and completing the wiping operation. People with physical disabilities such as bad backs, arthritis, injured hands, wrists, arms, shoulders or any other injury which immobilises the dexterous side of the body are often unable to complete the task of wiping with paper.

For example a right-handed person who is post operational eg. from a right shoulder rotata cuff tendon syndrome, whereby the right arm is immobilised, can suddenly find the task most difficult and sometimes impossible to accomplish with the left hand.

2) Bidets use water jets in toilet bowls. This apparatus is used more frequently in Continental countries and is somewhat more hygienic. However there are certain difficulties experienced with this method, in as much as copious quantities of water are used and a large area has to be dried, using once again a lot of paper and/or a towel which then has to be washed.

Bidets are additionally installed dedicated devices which are generally more expensive than the normal low down flushing toilet suite. Bidet devices fitted to a low down flushing suite have a number of problems associated with the installation and use of the devices. The following documents are examples:

U.S. Pat. No. 1,818,388 U.S. Pat. No. 2,852,782 U.S. Pat. No. 3,425,066, U.S. Pat. No. 3,995,326, U.S. Pat. No. 3,513,487, and U.S. Pat. No. 4,259,754.

These bidet devices are designed to be retrofitted to conventional flushing toilet bowls and often require extensive modifications to the normal plumbing installations. Furthermore the spray heads of these devices and dedicated bidets are mounted in a fixed position necessitating the use of a copious quantities of water, wetting a large area in the endeavour to accomplish thorough cleaning of the anus. A question of the hygienic state of these devices also exists due to the possibility of improper cleaning of the device after each usage.

3) Hand Held Bidets and Douches are also known.

Examples include:

U.S. Pat. No. 3,110,038, U.S. Pat. No. 3,662, U.S. Pat. No. 3,797,481, U.S. Pat. No. 3,882,864, U.S. Pat. No. 4,000,742, U.S. Pat. No. 4,197,594, U.S. Pat. No. 4,205,402, U.S. Pat. No. 4,510,630, U.S. Pat. No. 4,596,058, AU-B-63102/90, CA2149839, DE4421424, JP2000-051313, JP09262187, JP2000-093483 and JP2000-070325.

The prior art hand held devices incorporating water sprays can be used to clean the anal area but are such that the positioning of the water spray is by the operation of the device and the sensitive feel of the water spray on the user's body skin. The operation of such devices whereby one cannot see the area to be cleaned requires guesswork and dexterity by the operator.

Such prior art hand held cleaning devices can cause damage if held in contact with the surface of body parts. Such prior art devices can also cause cross contamination and infection to other parts of the body.

Prior art hand held bidets and douches in the main tend to wet a large area which has to be dried. This in itself becomes a problem.

It would be advantageous if a device could be provided that is simple to manufacture and use.

SUMMARY OF THE INVENTION

The present invention provides an anal cleaning device including:

a fluid flow directing member connectable to a fluid source and having a fluid outlet for directing fluid from the source out of the member; and a wall member projecting out from the flow directing member near the fluid outlet and positionable at a perinaeum of a user such that, when located thereat, the wall member spaces the fluid outlet from the user's anus and tends to prevent fluid from reaching that side of the wall member opposite to the fluid outlet side of the wall member.

The device can be provided in a personal hygienic hand held format for anal cleaning and can also be used in conjunction with a conventional toilet-flushing unit. Further, it can be used in other toilet facilities where there is a supply of pressurised water. Whilst typically the device is used for releasing liquids (such as water), it can also be used to direct gases (such as air) for anal drying, deodorising and sanitising purposes.

In accordance with the present invention advantageously the flow directing member and the wall member can be manufactured simply. In addition, the wall member can help locate the device (eliminating guesswork) and can prevent liquid and faeces splashing forwards toward the genital area. In this regard, the wall member of the present invention can enable easy and correct positioning of the device by allowing the user to feel that the device is in the correct position. This feature is even more important when the user has the use of only one arm. Also, as a hand held unit, the device can be easily positioned and operated efficiently and effectively, and used to wet only a small area.

Preferably the flow directing member is a cleaning head, with the wall member formed integrally with the head to project orthogonally therefrom and intermediate a first end connectable to a fluid source line and a second opposite end near which the fluid outlet is located. For example, the wall member can be moulded or formed integrally with the cleaning head (eg. from plastics, or cast from metal).

Preferably, the wall member is generally trapezoidal in shape, tapering outwardly from a relatively narrower base, mounted at the flow-directing member, to a relatively wider remote free end.

Preferably, the wall member remote end is an edge adapted for close (and thereby comfortable) positioning at the user's perineum. Preferably the edge is a curved and rounded, and also has a curvature along its length that is adapted for close positioning at the perineum.

Preferably the wall member is relatively stiff or inflexible.

Preferably the device is adapted for use with a conventional low down suite within a toilet facility.

Preferably the flow directing member is connected via a fluid conveying rod to a handle. In this regard, the handle typically comprises a separate component in the device, however can also be defined by a part of the conveying rod itself. Preferably the rod is also relatively inflexible such that, in conjunction with the handle, it can be used to position the wall member at the user's perineum.

Preferably the flow directing member is defined by or at a remote end of the fluid conveying rod away from the handle. Also, the rod can be bent intermediate its ends, to aid angled positioning of the wall member adjacent to the anus.

As an alternative, the wall member can be mounted at the rod remote end either directly or via a collar which is slidable along and selectively fastenable at the rod remote end.

Preferably the handle incorporates a means for controlling a supply of typically pressurised liquid from a flexible conduit attached to an inlet to the handle. Preferably the controlling means is a manually operated, easily opened, but normally biased-shut piston valve.

Preferably, the valve is configured such that differential forces from pressurised liquid within the handle, typically resulting from a pressurised liquid supply control tap being opened, keeps the valve normally shut.

Preferably the piston valve is opened with a force applied against a spring-return lever fitted into the handle. Preferably the lever pivots about a fulcrum point and, in so doing, an opposing end of the lever, which typically has toggle forked legs which straddle the piston valve, transfers such force, and the piston valve is then moved to an open position.

Preferably the volume of flow through the device is reduced by restricted passages within the piston valve. Preferably a body of the handle is through-bored, and in which bore the piston valve is arranged, the piston valve having a bore extending partway therethrough, the piston valve interacting with the handle such that, in a closed position, the piston valve closes the through-bore of the handle, and in an open position liquid flows through the handle via the bore of the piston valve, and thence out of the device. Thus, when the piston valve is open, liquid is supplied to the flow directing member, (eg. via the fluid conveying rod) and thence to the fluid outlet where it typically discharges as a jet or jets to the anus.

The device can be operated externally to the toilet bowl by depressing the lever within the handle, and the handle can be fixed at any rotational position to suit the user. In this regard, the handle can be assembled at any degree of angular rotation in relation to the anal cleaning head, as required by incapacitated people.

The anal cleaning device can include a fail-safe mechanism such that a small force only is required for the operation of the device, to ensure that the liquid supply is easily stopped.

The wall member is preferably sized and configured to prevent an end of the flow directing member from accidentally being directly inserted into any aperture of the body.

Preferably the cleaning device can be stored in a sanitary position outside the toilet bowl within easy reach of the user, preferably within the confines of a container in which is held a quantity of disinfectant solution for washing the cleaning head of the device. In this regard, preferably the hygienic storage container is either wall or floor mounted. The storage container preferably incorporates a sump of disinfectant solution so that the anal cleaning head can be dunked, before the device is located in a holding bracket to drip-dry for the next user. However, as stated above, the cleaning head and conveying rod can be easily disconnected for storage.

The cleaning head and fluid conveying rod may also be detached from the handle and, if necessary, washed over the low down suite bowl with the water spray from the handle, and then stored out of sight. This also allows for the use of various cleaning heads, and may be a preferred aesthetic feature for the user of the device.

The device can be economically viably manufactured as a personal hygienic device which is inexpensive to purchase and fit to a toilet suite and which, with modern production techniques, can be made lightweight (eg. mainly or entirely of plastics) and readily accessible for disabled people.

Advantageously, the device can be operated with one hand, thus allowing handicapped and disabled people usage thereof. The device can also reduce the use of toilet paper.

The pressurised liquid supplied to the device is preferably via a conveniently positioned wall mounted tap, preferably lever operated. For simplicity, and because domestic water pressure varies from one location to another, this tap can be opened to give approximately the liquid pressure desired by the user. Users can thereafter become familiar with their requirements.

Alternatively an installation can be provided that incorporates a pressure control valve and mixing device utilising eg. hot and cold water.

The fluid conveying rod can be made from aluminium for lightness or stainless steel if a more durable product is required. Preferably the whole device is lightweight.

Preferably the fluid conveying rod is of sufficient length to enable the device to be operated external to the toilet bowl, however may be shortened, eg. for users who prefer a shorter offset rod version. Typically the end of the conveying rod is an open tube for insertion into the cleaning head. Preferably the cleaning head has at least one fluid outlet in the form of an orifice which comes into communication with the liquid supply when the hand operated valve in the handle is opened.

Also, interchangeable cleaning heads having varying configurations of liquid jets can be provided, thus offering a user a choice of different cleaning actions, as may be required.

Preferably the wall member is located adjacent to the fluid outlet. Preferably the wall member is generally perpendicular to an axis of the fluid conveying rod. As stated above, the wall member may be separately affixed to the rod. The direction of the ensuing liquid jet exiting the fluid outlet is preferably perpendicular to a flow direction of fluid through the device or is angled slightly rearward of perpendicular.

Furthermore preferably all corners and edges of the device are preferably rounded so to prevent bodily damage.

Preferably the fluid conveying rod is a hollow circular-sectioned tube, but can be of any other shape as may be desired.

Preferably the fluid outlet (eg. orifice) is circular without limiting the use of other jet shapes which might be used.

Also, in certain installations it may be considered advantageous to have heated liquid supplied from a modern state of the art mixing device at a constant preset temperature and/or pressure.

Thus, in accordance with the present invention the wall member maintains a definite distance between the outlet and the surface of the anus. The device therefore prevents damage which could otherwise be caused if the spray jet were to be accidentally positioned to close or inserted into the anus, which is a possibility with many prior art devices.

BRIEF DESCRIPTION OF THE DRAWINGS

Notwithstanding any other forms which may fall within the scope of the present invention, preferred forms of the invention will now be described, by way of example only, with reference to the accompanying drawings in which.

MODES FOR CARRYING OUT THE INVENTION

Figure 1:
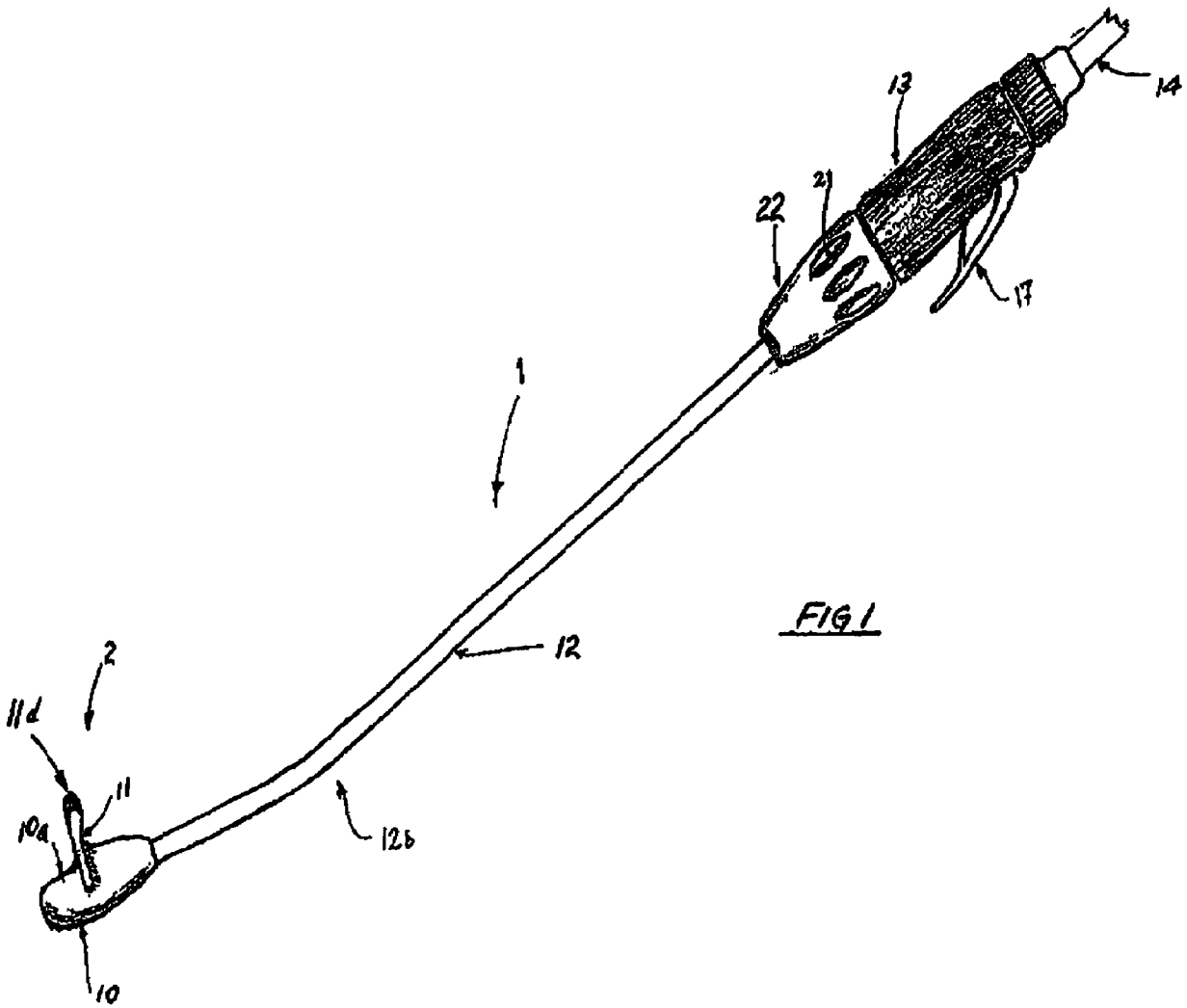
FIG. 1 shows a perspective view of a first preferred anal cleaning device in accordance with the present invention.

Referring firstly to FIGS. 1 to 9, where like reference numerals represent similar or like parts, FIG. 1 shows a perspective view of a first preferred anal cleaning device 1 in accordance with the present invention. The device 1 includes a handle 13 having various parts as shown in FIGS. 5 to 8. A flexible supply tube 14 is connected to the handle and pressurised water is supplied thereto, typically from a wall mounted tap, preferably of the lever operated type.

The device includes a fluid conveying rod in the form of a hollow cylindrical bent tube 12 (bent at 12*b*) with the length and bend being sufficient to allow for easy positioning of the device eg. with one's forearm resting on one's thigh.

Figure 12:
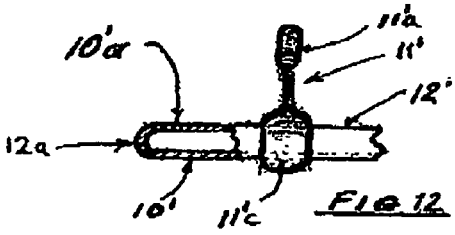
FIG. 12 shows a side, partially sectioned detail of the cleaning head of FIG. 11 located on a rod of the device.
Figure 13:
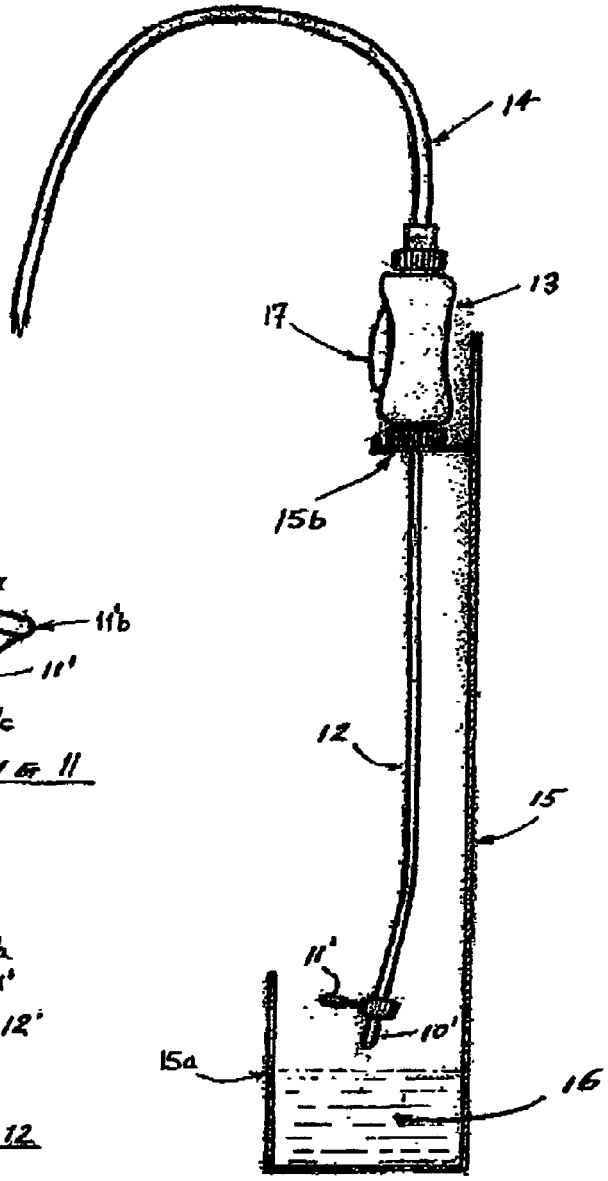
FIG. 13 shows a side view of the device of FIG. 10 in a stored position in a storage container.

The device also includes a flow directing member such as for example a cleaning head 2 having a partly hollow (FIG. 3) cleaning head body 10. A wall member in the form of flange 11 projects generally orthogonally from the body 10. The flange 11 is typically integrally formed (e.g. moulded or machined) with body 10, although it may be fitted separately to the device (e.g. by sliding a collar 11*c* (FIG. 12) over the end of tube 12). A single orifice 10*a* is formed in the cleaning head body 10, however, multiple orifices may be employed as appropriate. The cleaning head is further detailed in FIGS. 2, 3 and 4.

Figures 2, 3, 4:
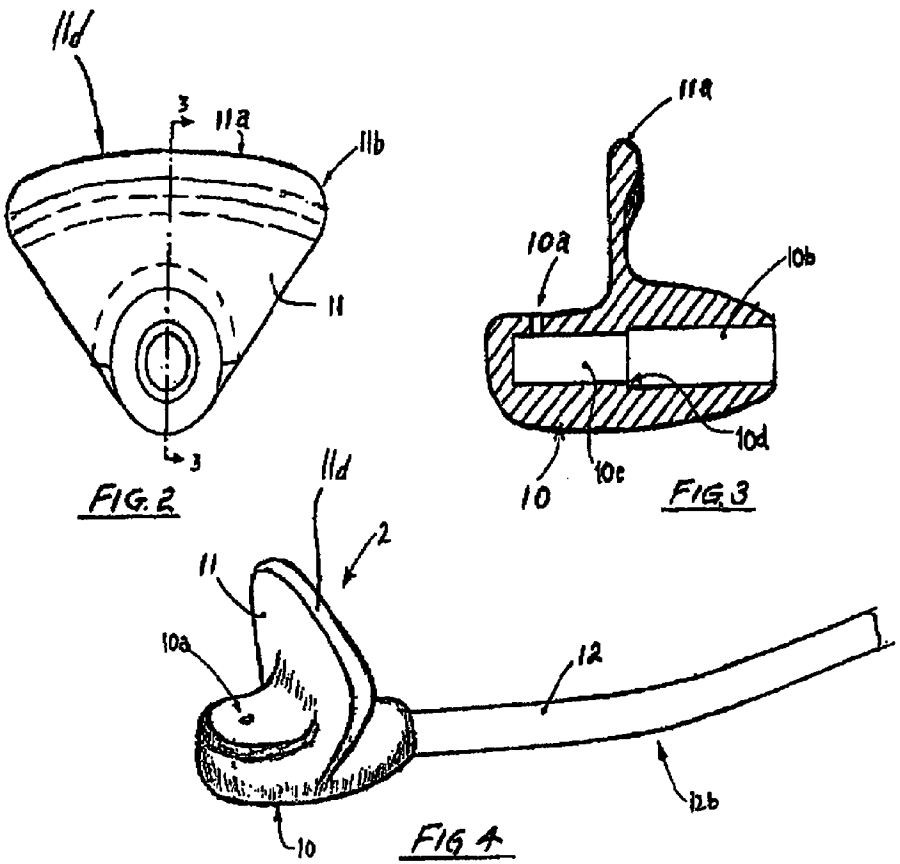
FIG. 2 shows an end view of a cleaning head connection end of the device of FIG. 1.
FIG. 3 shows a side sectional view of the cleaning head taken on the line 3-3 of FIG. 2.
FIG. 4 shows a perspective detail of the rod and cleaning head.

FIG. 2 shows an end view of the cleaning head at its connection end (ie. where it connects to tube 12). In this regard, the tube 12 is inserted snugly into a tubular recess 10*b* of body 10 (FIG. 3) which in turn opens onto a narrower recess 10*c*, defining a shoulder 10*d* against which an end of tube 12 can abut (eg. sealingly via an o-ring (not shown). Thus the head 2 can be permanently or releasably attached to the end of tube 12 via any suitable means including adhesive, welding, grub screw(s), screw threading, bayonet fitting, ball detent, interference, friction or snap-fitting etc.

The flange 11 is plate-like and generally trapezoidal in shape, having a rounded free end lip 11*a* and curved ends 11*b*. Lip 11*a* functions as a positioning bar and accordingly is circular in cross section and rounded on the ends of the arc 11*d* as shown, to be optimally shaped to sit generally flush against a user's perineum. It can be seen in, for example, FIGS. 2 to 4 that arc 11*d* is non-concentric with the central axis of tube 12 adjacent the flange 11.

The orifice 10*a* is typically an upwardly directed jet, such that water which issues forth from the orifice 10*a* is directed parallel to and in-line with a centre line of the flange 11 (ie. in-line with the centre of the lip 11*a*). Alternatively the orifice can be defined such that exiting water is directed to issue back towards flange 11 (ie as an angled stream). The cleaning head and flange can be manufactured from stainless steel components, as a single piece polished investment casting, as cast porcelain or other ceramic, or preferably injection moulded from plastic material.

FIG. 4 shows a perspective view of the tube 12 and cleaning head 2. In this embodiment the flange and orifice are moulded integrally to form a unitary cleaning head. The tube 12 is then fastened into the cleaning head.

Figures 5, 6, 7, 8:
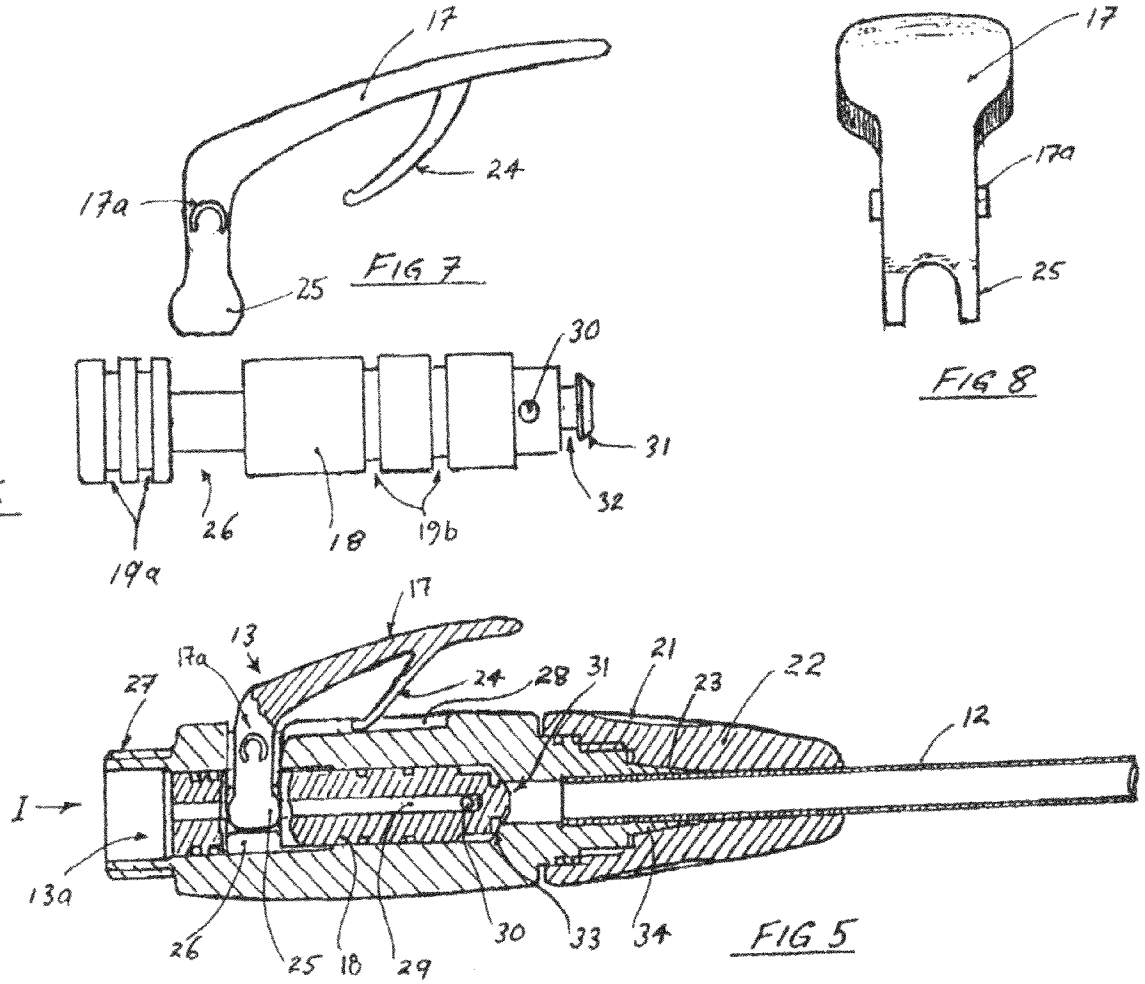
FIG. 5 shows a side sectional view of a handle of the device of FIG. 1.
FIG. 6 shows a side view of a valve body part of the handle of FIG. 5.
FIG. 7 shows a side view of a control lever part of the handle of FIG. 5.
FIG. 8 shows an end view of the lever of FIG. 7.

FIG. 5 shows a cross-sectional detailed view of the handle 13, including a fragmentary sectional view of a piston valve 18 and operating trigger lever 17. FIG. 6 shows a side view of the piston valve body 18 and FIG. 7 shows a side view of the operating lever 17 and a biasing lever spring 24 as a singular moulded piece. FIG. 8 shows an end view of the operating lever showing the forked toggle 25 which straddles the piston valve 18.

When assembled fulcrum bearings 17*a* of lever 17 fit into place on fulcrum pins moulded into the valve body recess for the operating lever. The handle is configured such that a light force is required to depress trigger lever 17. When so depressed the lever pivots on fulcrum bearings 17*a*, moving against biasing lever spring 24, the end of which slides in recess 28. In so pivoting the toggle legs 25, which straddle the piston valve body 18 at recess 26, urge the piston valve towards the handle inlet end I (so marked).

Valve body 18 is positioned to slide in this passage. A liquid flow passage 13*a* extends right through handle 13. Valve body 18 has a longitudinal bore 29 extending almost completely therethrough, inwardly from its end adjacent inlet end I. A laterally extending passage 30 connects to bore 29 and opens onto an adjacent part of passage 13*a*. The valve body 18 has a closed opposite plug end 31, having an adjacent annular recess 32 into which a flexible sealing ring (eg. O-ring) can be located. In a normal orientation of the handle, the plug end 31 closes part of passage 13*a* (ie. the restricted part at shoulder 33) to prevent liquid flow therethrough. Thus, liquid leaving passage 30 is stagnant in the adjacent part of passage 13*a* so that the device is closed to fluid flow. However, when the lever 17 is depressed it urges the valve body towards inlet I. The plug end 31 opens the passage adjacent to shoulder 33, thus bringing the inlet I into fluid communication with tube 12, so that liquid can flow through the device, flowing through the valve body.

When lever 17 is released, water pressure moves piston 18 back and/or the spring 24 pivots the lever 17 back away from handle 13, thus returning the valve body 18 to its position in FIG. 5, and returning plug end 31 into a sealing configuration. In this regard, spring 24 is typically a leaf spring which assists to close the piston valve when the liquid pressure is insufficient to close the piston valve by differential pressure, the leaf spring acting as a fail-safe mechanism. This again closes passage 13*a* to liquid flow therethrough.

The handle 13 has an externally threaded male connection 27 at the inlet end, which is compatible with and attachable to a flexible plumbing pressure hose (see FIG. 1).

Figures 14, 15, 16, 17:
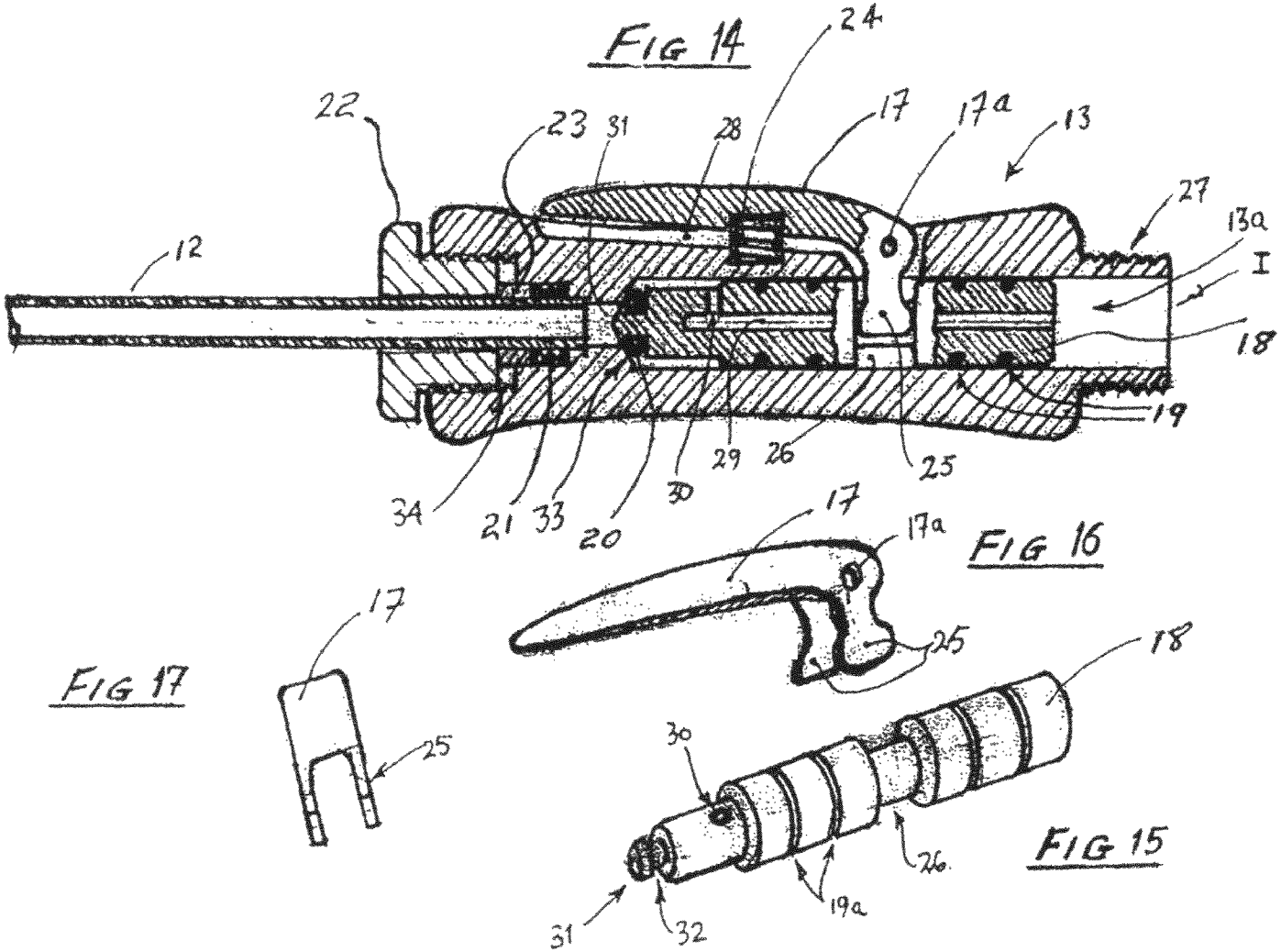
FIG. 14 shows a side sectional view of a handle of the device of FIG. 10.
FIG. 15 shows a perspective view of a valve body part of the handle of FIG. 14.
FIG. 16 shows a perspective view of a control lever part of the handle of FIG. 14.
FIG. 17 shows an end view of the lever of FIG. 16.

The handle 13 is internally finished to accommodate the ready sliding of piston valve body 18 therein. Valve body 18 can also have either two or four O-rings 19, as shown in FIG. 14, fitted at 19*a* and 19*b* (ie. on either side of toggle legs 25) to prevent liquid flow around its outside, thereby preventing loss of liquid through the operating lever aperture. The sealing ring at plug end 31 prevents flow in the closed position.

Tube 12 is a sliding fit in the recess provided in handle 13. To connect tube 12 to handle 13, a nut 22 having a conical female internal face 23 is tightened against a mating conical male thin-walled-section 34 in handle 13. The internal face of the thin-walled conical section 34 is a close fit on the tube 12. When tightened the conical sections provide a clamping effect on tube 12. Screwed nut 22 has recessed grip sections 21 on its outer periphery and is a sliding fit on tube 12. This arrangement thus supports the tube 12 in, and affixes it to, the handle 13, but also allows it to be released therefrom for cleaning, servicing, interchange or replacement.

Figure 9:
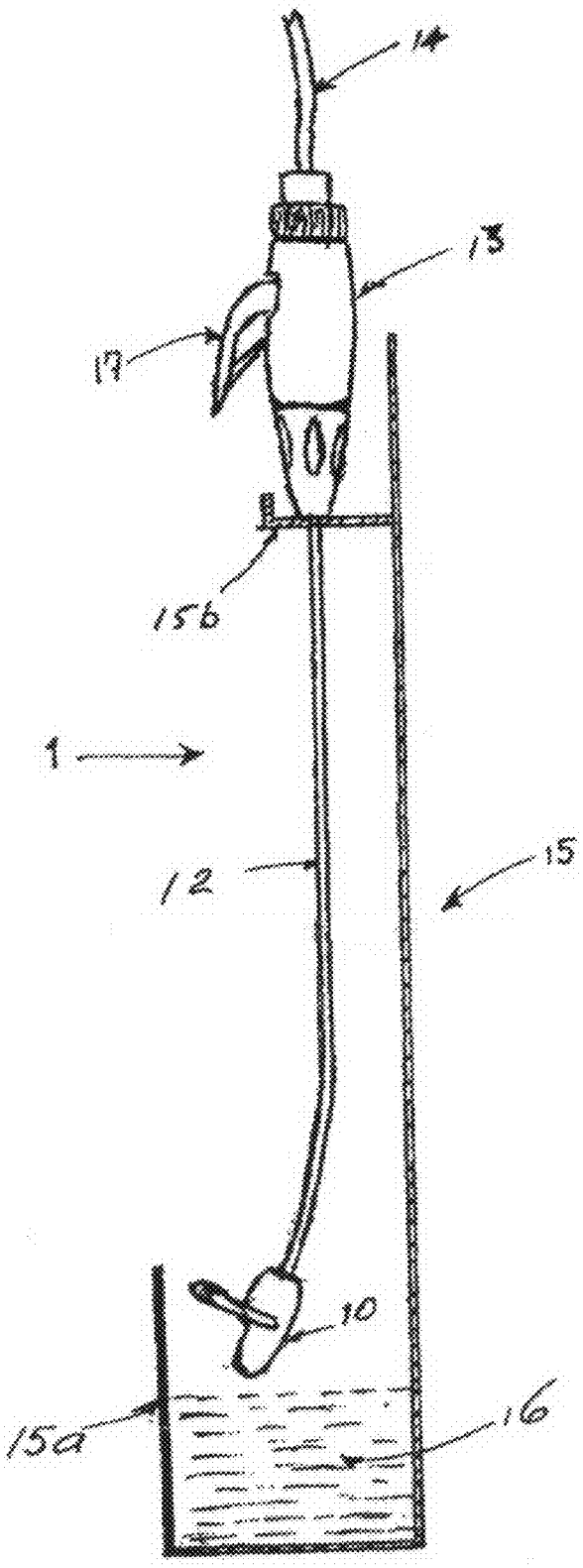
FIG. 9 shows a side view of the device of FIG. 1 in a stored position in a storage container.

FIG. 9 shows a cross sectional view of a container 15 for the storage of the device between uses. The cross sectional shape of the container base 15*a* can be circular, square, rectangular or any other shape which fits the confines of a toilet area, in which the device is used. Disinfectant solution 16 is located in the receptacle defined by base 15*a*, and into which the cleaning head 2 can be immersed and agitated for cleaning/disinfecting. A lateral bracket 15*b* supports the device above solution 16 so that it can drip dry prior to its next use.

Referring now to FIGS. 10 to 17, where like reference numerals are used to denote similar or like parts, alternative anal cleaning devices are depicted.

The handle 13 is essentially the same as the first embodiment except that leaf spring 24 is replaced by a helical spring captured within lever 17.

Figure 10:
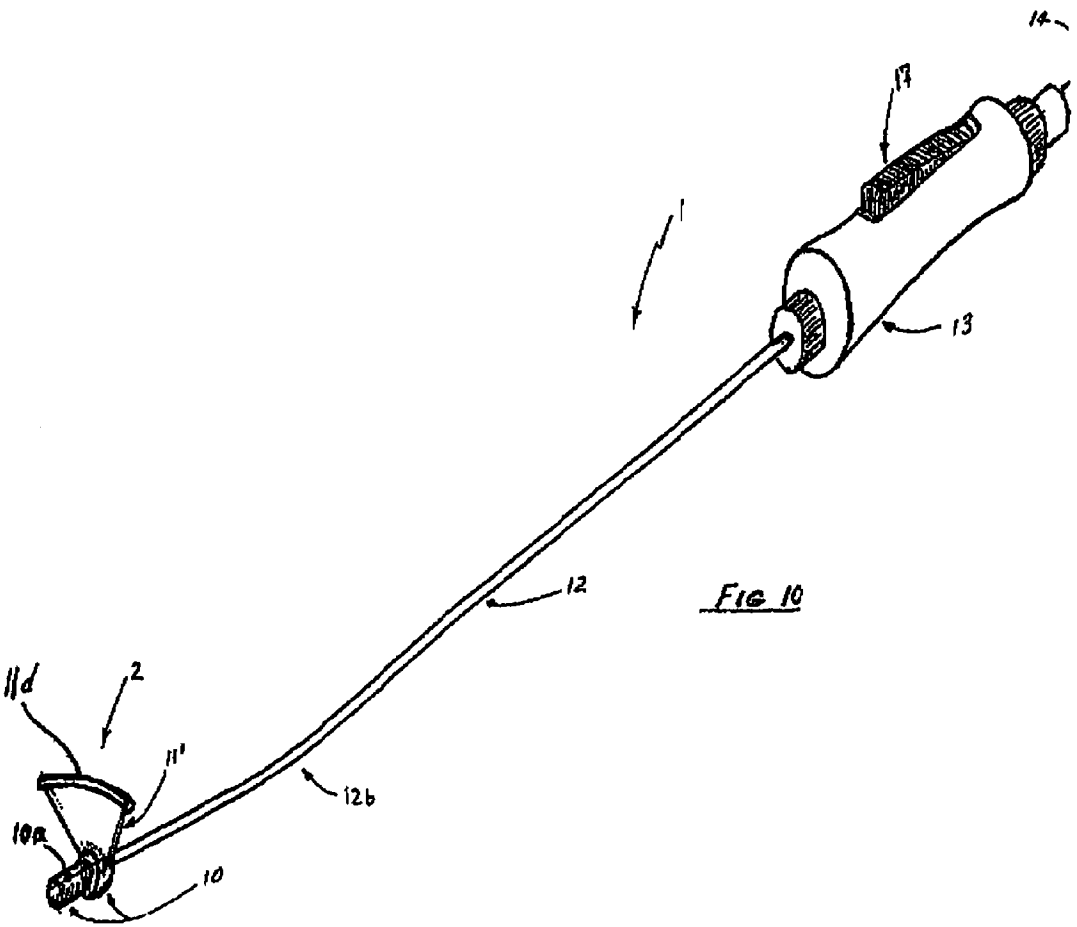
FIG. 10 shows a perspective view of a second alternative anal cleaning device in accordance with the present invention.
Figure 11:
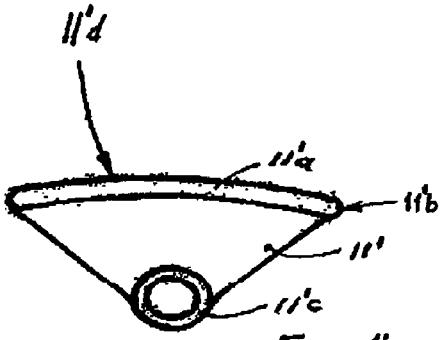
FIG. 11 shows an end view of another cleaning head for use with the device of FIG. 10.

In FIG. 10 the cleaning head 2 is again fitted onto the end of tube 12 as shown, with the flange 11' again extending out from body 10: However, in FIGS. 11 to 13 the tube 12 is closed at tube end 12*a*, with the orifice 10'*a* being defined (eg. formed or drilled) into tube end 12*a* thereby forming the flow directing member. Thus, in this case the body 10" is defined by tube end 12*a*. Also, in this embodiment flange 11' extends from a collar 11'*c* which is slid onto the tube end 12*a* and then fastened thereto adjacent orifice 10'*a* (e.g. via welding, adhesive, grub screw, screw thread etc). Thus, the tube 12 can be detached from the handle 13 as described above, and the flange 11' can also be detached from the tube 12, for cleaning, servicing, interchange, replacement etc.

Also, the flange 11' of FIGS. 10 to 13 is thinner in profile than flange 11 of the first embodiment. In other respects the cleaning devices are similar or the same. Arc 11*d* is again shown as being non-concentric with the central axis of tube 12 adjacent the flange 11'.

The tube 12 can be interchanged as described above so that shorter or longer, bent or straight tubes can be employed as appropriate. In addition, different flange sizes can be employed for different users. Also heads having multiple orifices can be employed.

The supply tube 14 can be connected to a toilet water supply and to a pressure regulator as appropriate. Alternatively it may be connected to a hot/cold water mixer for delivering cleaning water of appropriate temperature. It may also be able to be selectively connected to an air supply eg. from central heating, for anal drying after washing.

Typically many of the components are formed from injection moulded plastics or corrosion-resistant metals such as aluminium and stainless steel.

Whilst the invention has been described with reference to a number of preferred embodiments, it will be appreciated that it can be embodied in many other forms.

The invention claimed is:

1. A hand held anal cleaning device, comprising:

a fluid conveying rod;

a cleaning head, connectable at its rear end to the fluid conveying rod;

the cleaning head having a fluid outlet that directs all fluid from the fluid conveying rod out of the cleaning head in a direction perpendicular to the direction of flow into the cleaning head or angled slightly rearwardly thereof;

a plate-shaped wall member located behind the fluid outlet and projecting orthogonally from the cleaning head, the plate-shaped wall member being generally trapezoidal in shape, tapering outwardly from a relatively narrower base located at the head, to a relatively wider arc shaped edge that is non-concentric with a central axis of the fluid conveying rod, and the arc shaped edge being shaped for flush positioning at a user's perineum, such that when located there, the wall member spaces the fluid outlet from the user's anus, and tends to prevent fluid from splashing to the rear of the wall member.

2. A device as claimed in claim 1 wherein the plate-shaped wall member is formed integrally with the head.

3. A device as claimed in claim 1 or 2 wherein the fluid conveying rod, remote from the head, is connectable to a handle.

4. A device as claimed in claim 3 wherein the fluid conveying rod, in conjunction with the handle, can be used to position the wall member arc shaped edge at the user's perineum.

5. A device as claimed in claim 3 wherein the fluid conveying rod bends intermediate its ends, to aid angled positioning of the wall member arc shaped edge adjacent to the anus.

6. A device as claimed in claim 3 wherein the handle incorporates a valve for controlling a supply of liquid from a flexible conduit attached to an inlet to the handle, the valve being manually operated, and being a normally biased-shut piston-type valve.

7. A device as claimed in claim 6 wherein the valve is configured such that differential forces from pressurized liquid within the handle keep the valve normally shut.

8. A device as claimed in claim 7 wherein a biasing spring acts in addition or alternatively to the differential liquid forces to keep the valve normally shut.

9. A device as claimed in claim 7 wherein the valve is opened by a lever in the handle which pivots about a fulcrum point and, in so doing, an opposing end of the lever acts on the piston valve and moves it to an open position.

10. A device as claimed in claim 6 wherein a body of the handle is through-bored, and in which bore the piston valve is arranged, the piston valve having a bore extending partway therethrough, the piston valve interacting with the handle such that, in a closed position the piston valve closes the through-bore of the handle, and in an open position liquid flows through the handle via the bore of the piston value, and thence out of the device.

11. A device as claimed in claim 1 or 2 wherein the cleaning head is detachable from the fluid conveying rod for interchange with another cleaning head.

12. A hand held anal cleaning device, comprising:

a fluid conveying rod;

a flow directing member that is defined by the front end to the fluid conveying rod;

the flow directing member having a fluid outlet for directing fluid from the fluid conveying rod out of the flow directing member in a direction perpendicular to the direction of flow into the cleaning head or angled slightly rearwardly thereof;

a plate-shaped wall member located behind the fluid outlet and projecting orthogonally from the cleaning head, the plate-shaped wall member being generally trapezoidal in shape, tapering outwardly from a relatively narrower base located at the head, to a relatively wider arc shaped edge that is non-concentric with a central axis of the fluid conveying rod, and the arc shaped edge being shaped for flush positioning at a user's perineum, such that when located there, the wall member spaces the fluid outlet from the user's anus, and tends to prevent fluid from splashing to the rear of the wall member.

13. A device as claimed in claim 12 wherein the wall member is mountable at the flow directing member either directly or via a collar which is slidable along and selectively fastenable at the flow directing member.

14. A device as claimed in claim 12 or 13 wherein the fluid conveying rod, remote from the flow directing member, is connectable to a handle.

15. A device as claimed in claim 14 wherein the fluid conveying rod, in conjunction with the handle, can be used to position the wall member arc shaped edge at the user's perineum.

16. A device as claimed in claim 14 wherein the fluid conveying rod bends intermediate its ends, to aid angled positioning of the wall member arc shaped edge adjacent to the anus.

17. A device as claimed in claim 14 wherein the handle incorporates a valve for controlling a supply of liquid from a flexible conduit attached to an inlet to the handle, the valve being manually operated, and being a normally biased-shut piston-type valve.

18. A device as claimed in claim 17 wherein the valve is configured such that differential forces from pressurized liquid within the handle keep the valve normally shut.

19. A device as claimed in claim 18 wherein a biasing spring acts in addition or alternatively to the differential liquid forces to keep the valve normally shut.

20. A device as claimed in claim 18 wherein the valve is opened by a lever in the handle which pivots about a fulcrum point and, in so doing, an opposing end of the lever acts on the piston valve and moves it to an open position.

21. A device as claimed in claim 17 wherein a body of the handle is through-bored, and in which bore the piston valve is arranged, the piston valve having a bore extending partway therethrough, the piston valve interacting with the handle such that, in a closed position the piston valve closes the through-bore of the handle, and in an open position liquid flows through the handle via the bore of the piston valve, and thence out of the device.

22. A device as claimed in claim 1 or 12, wherein the wall member arc shaped edge is also rounded.

* * * * *